US005795139A

United States Patent [19]

Ikeda et al.

[11] Patent Number: 5,795,139

[45] Date of Patent: Aug. 18, 1998

[54] SWASH PLATE TYPE REFRIGERANT COMPRESSOR WITH IMPROVED INTERNAL LUBRICATING SYSTEM

[75] Inventors: Hayato Ikeda; Masanobu Yokoi, both of Kariya; Hiromi Michiyuki, Anjo; Hisato Kawamura, Kariya; Hirofumi Satoh, Kariya; Noriyuki Shintoku, Kariya, all of Japan

[73] Assignee: Kabushiki Kaisha Toyoda Jidoshokki Seisakusho, Kariya, Japan

[21] Appl. No.: 615,104

[22] Filed: Mar. 14, 1996

[30] Foreign Application Priority Data

Mar. 17, 1995 [JP] Japan ..... 7-059415
Jan. 30, 1996 [JP] Japan ..... 8-013890

[51] Int. Cl.[6] ..... F04B 1/16; F04B 1/18

[52] U.S. Cl. ..... 417/269; 184/6.17; 62/470

[58] Field of Search ..... 184/6.17; 417/269, 417/222.2; 92/71; 91/499, 502; 62/470

[56] References Cited

U.S. PATENT DOCUMENTS

| | | | |
|---|---|---|---|
| 3,057,545 | 10/1962 | Ransom et al. | 417/269 |
| 3,955,899 | 5/1976 | Nakayam et al. | 417/269 |
| 4,746,275 | 5/1988 | Iwamori et al. | 184/6.17 |
| 4,767,283 | 8/1988 | Ikeda et al. | 184/6.17 |
| 4,990,064 | 2/1991 | Ikeda et al. | 417/269 |
| 5,076,764 | 12/1991 | Kawai et al. | 184/6.17 |
| 5,178,521 | 1/1993 | Ikeda et al. | 184/6.17 |
| 5,181,834 | 1/1993 | Ikeda et al. | 184/6.17 |

FOREIGN PATENT DOCUMENTS

| | | |
|---|---|---|
| 3407321 | 2/1984 | Germany . |
| 3615459 | 5/1986 | Germany . |
| 3643592 | 12/1986 | Germany . |
| 4006338 | 3/1990 | Germany . |
| 4318635 | 6/1993 | Germany . |
| 19533340 | 9/1995 | Germany . |
| 47-25204 | 11/1972 | Japan . |
| 48-602 | 1/1973 | Japan . |
| 55-109782 | 8/1980 | Japan . |
| 61-184886 | 11/1986 | Japan . |
| 3-7581 | 2/1991 | Japan . |

*Primary Examiner*—Charles G. Freay
*Assistant Examiner*—Peter G. Korytnyk
*Attorney, Agent, or Firm*—Burgess, Ryan & Wayne

[57] ABSTRACT

A refrigerant compressor, typically a swash plate type refrigerant compressor for compressing refrigerant gas containing therein lubricating oil, which has axially combined cylinder blocks having a plurality of cylinder bores in which a plurality of pistons reciprocate to implement suction and compression of refrigerant gas as well as discharge of the compressed refrigerant gas. The cylinder blocks further have a swash plate chamber for a swash plate supported by a sliding type thrust bearings, receiving the refrigerant gas returning from an exterior of the compressor, and an axially extending central through-bore for a drive shaft supported by radial bearings. The compressor has a lubricating oil system which includes a fluid passageway for supplying a part of the refrigerant gas containing the lubricating oil from refrigerant gas inlet passageways in the cylinder blocks into the central bore to lubricate the sliding type thrust bearings and the radial bearings. Additional gas passageways may be provided in the valve plate for providing communication between some cylinder bores and the central bore in synchronism with opening of suction valves of some cylinder bores so that introduction of the part of the refrigerant gas into the central bore from the swash plate is promoted.

24 Claims, 10 Drawing Sheets

SWASH PLATE TYPE REFRIGERANT COMPRESSOR WITH IMPROVED INTERNAL LUBRICATING SYSTEM

BACKGROUND OF THE INVENTION

1. Field of the Invention

The present invention relates to a cam-plate operated piston compressor, such as a swash plate type compressor, adapted for being incorporated in a climate control system of an automobile and having an axial cylinder block assembly including front and rear cylinder blocks, each having a plurality of cylinder bores acting as operating chambers for compressing refrigerant gas by the cooperation of a plurality of reciprocating pistons driven by a swash plate mounted on a rotating drive shaft. The cylinder bores of the front and rear cylinder blocks are arranged to be coaxial so as to permit the plurality of pistons to perform smooth reciprocation in the cylinder bores of both cylinder blocks. More particularly, the present invention relates to an improved internal lubricating system of a swash plate type compressor, which enables incorporation of sliding type bearings therein.

2. Description of the Related Art

Generally, a swash plate type compressor is provided with a plurality of double-headed pistons reciprocating in a plurality of cylinder bores formed in an axial cylinder block assembly which is formed by combining a pair of front and rear cylinder blocks. The reciprocation of the double-headed pistons is caused by the rotation of a swash plate mounted on a rotating drive shaft. The cylinder block assembly has axial front and rear ends closed by front and rear housings in which a suction chamber for refrigerant gas before compression and a discharge chamber for compressed refrigerant gas are formed. The suction chamber is usually formed in a radially outer portion of the housing, and the discharge chamber is arranged radially inside the suction chamber. Alternately, in another arrangement, the suction chamber is arranged at a central portion of the housing, and the discharge chamber is annularly arranged around the suction chamber.

When the discharge chamber is arranged at a radially inner portion of the housing so as to be enclosed by the suction chamber within the housing, the structure of a discharge valve unit provided between the respective cylinder bores and the discharge chamber can be advantageously simpler as typically disclosed in, for example, Japanese Unexamined Utility Model Application No. 3-7581. In the swash plate type compressor having the inner discharge chamber and the outer suction chamber, when a refrigerant gas has returned from the external climate control system to the swash plate type compressor, the gas enters a swash plate chamber of the compressor via an inlet port of the compressor, and flows from the swash plate chamber toward the suction chamber through suction passageways extending through axial bores formed in the front and rear cylinder blocks to receive long screw bolts for tightly combining the front and rear cylinder blocks. Thus, the refrigerant gas containing oil mist therein lubricates thrust bearings supporting the swash plate rotatably received in the swash plate chamber. The refrigerant gas containing oil mist further lubricates radial ball or roller bearings rotatably supporting the drive shaft which is arranged so as to extend through an axial central bore formed in the cylinder block assembly. Namely, the refrigerant gas containing oil mist flows from the swash plate chamber toward the radial bearings via gas passageways extending between the swash plate chamber and the axial central bore.

Further, there has been proposed a different lubricating means for lubricating respective sliding portions of a swash plate type compressor by using oil mist separated from the compressed refrigerant gas before it is delivered from the compressor to the external climate control system. The separation of oil mist from the compressed refrigerant gas is advantageous from the viewpoint of preventing reduction in the efficiency of heat exchanging operation carried out in the climate control system. In connection with the above proposal, a unit for separating oil mist from the compressed refrigerant gas is proposed which is directly incorporated in the compressor or formed so as to be integral with the body of the compressor.

In the swash plate type compressor incorporating therein the unit for separating the oil mist from the compressed refrigerant gas, an oil collecting chamber for collecting oil which separates from the compressed refrigerant gas in a high pressure region of the compressor, and an oil receiver chamber in a low pressure region of the compressor (e.g., the swash plate chamber) in which the oil separating from the compressed gas is received are in fluid communication with one another via an oil passageway. In the oil passageway, one of various kinds of flow control valves such as a float type valve is arranged to permit a suitable amount of oil to constantly flow from the oil collecting chamber to the oil receiver chamber and to prevent the compressed refrigerant gas from directly flowing from the oil collecting chamber to the oil receiver chamber via the oil passageway when the oil collecting chamber is empty. Nevertheless, since the oil passageway has a very small cross-sectional area, a malfunction of the oil separating unit, such as plugging of the oil passageway can easily occur.

Further, even if the oil separating from the compressed gas successfully returns from the oil collecting chamber to the swash plate chamber (i.e., the receiving chamber), the refrigerant gas entering the swash plate chamber via the inlet port must flow toward the suction chamber of the housing via on the wall surface of the swash plate chamber due to a centrifugal effect provided by the rotating swash plate. Therefore, in the central portion of the swash plate chamber, amount of flow of the refrigerant gas is reduced. Accordingly, the radial ball bearings or roller bearings supporting the drive shaft of the compressor cannot be often lubricated by the oil mist contained in the refrigerant gas. As a result, the operating life of the radial ball or roller bearings must be reduced.

Further, when the thrust bearings supporting the swash plate employ less expensive sliding type thrust bearings having only a pair of slide plate elements and no ball and roller elements, the sliding surfaces of the slide plate elements cannot be sufficiently supplied with lubricating oil, and accordingly, the sliding type thrust bearings easily wear off.

SUMMARY OF THE INVENTION

Therefore, an object of the present invention is to provide a swash plate type compressor provided with an internal lubricating unit which is able to sufficiently and stably lubricate all of the internal rotating elements and parts of the compressor by using lubricating oil suspended or contained in a refrigerant gas, and which enables replacement of the conventional radial and thrust ball or roller bearings for supporting the rotating elements and parts of the compressor with less expensive sliding type bearings.

Another object of the present invention is to provide a swash plate type compressor provided with an internal lubricating unit able to lubricate all of bearings for supporting rotating elements and parts of the compressor and the associated parts of the rotating elements incorporated in the compressor even when the compressor incorporates therein no oil separating unit or when an oil separating unit incorporated in the compressor malfunctions.

A further object of the present invention is to provide a swash plate type compressor, for a climate control system of an automobile, including an internal lubricating unit having an oil reservoir section therein whereby the oil contained in the compressed refrigerant gas delivered into the climate control system can be appreciably reduced.

In accordance with a broad aspect of the present invention, there is provided a compressor incorporated in a climate control system for compressing a refrigerant gas containing therein lubricating oil, comprising:

a suction chamber means for the refrigerant gas before compression;

a discharge chamber means for the refrigerant gas after compression;

an operating chamber means having a variable volume chamber therein varying between a first predetermined volume position and a second reduced volume position, the variable volume chamber of the operating chamber means receiving therein the refrigerant gas from the suction chamber means during a volume expanding phase varying the variable volume of the chamber thereof to the first predetermined volume position, and compressing the refrigerant gas during a volume reducing phase varying the variable volume chamber thereof from the first predetermined volume position to the second reduced volume position;

a compressing-operation-drive means for driving the operating chamber means to alternately vary the volume thereof between the first predetermined volume position and the second reduced volume position;

a suction port means for providing fluid communication between the suction chamber means and the variable volume chamber of the operating chamber means;

a discharge port means for providing fluid communication between the discharge chamber means and the variable volume chamber of the operating chamber means;

a suction valve means for opening and closing the suction port means, the suction valve means opening the suction port means during the volume expanding phase of the operating chamber means to thereby allow the refrigerant gas before compression to flow from the suction chamber means into the operating chamber means; and a lubricating oil passageway means for permitting the refrigerant gas containing therein the lubricating oil to pass by a lubricated means arranged to be in association with the compressing-operation-drive means, the lubricating oil passageway means having one end brought into communication with the operating chamber means in synchronism with opening of the suction valve means and the other end formed to be in constant communication with a predetermined region in the compressor in which a pressure higher than a pressure in the operating chamber means during the volume expanding phase prevails.

Preferably, the suction valve means comprises a reed type valve.

Further preferably, the compressor comprises a swash plate type compressor which includes:

a cylinder block assembly having a pair of front and rear cylinder blocks defining therein a central bore axially extending therethrough, a plurality of axial cylinder bores arranged around the axial bore, and a swash plate chamber arranged at a connecting portion of the front and rear cylinder blocks;

a plurality of double-headed pistons slidably received in and cooperating with the plurality of cylinder bores to define the operating chamber means;

a drive shaft rotatably received in the central bore of the cylinder block assembly; and a swash plate arranged in the swash plate chamber and mounted on the drive shaft to rotate with the drive shaft, the drive shaft and the swash plate being operatively engaged with the plurality of double-headed pistons to define the compressing-operation-drive means.

Preferably, at least one of the cylinder bores of the cylinder block assembly of the swash plate type compressor is fluidly communicated with one end of the lubricating oil passageway means. Then, the lubricating oil passageway means includes a part thereof formed by the axial bore of the cylinder block assembly, and the other end of the lubricating oil passageway means is fluidly communicated with the swash plate chamber. The reed valve of the swash plate type compressor is interposed between each axial end of the cylinder block assembly and a valve plate, and a part of the lubricating oil passageway means is provided so as to extend between each axial end of the cylinder block assembly and the reed valve.

In accordance with another aspect of the present invention, there is provided a swash plate type refrigerant compressor which comprises:

a pair of axially combined front and rear cylinder blocks defining therein a central through-bore extending axially, a plurality of axial cylinder bores arranged around the central through-bore, and a swash plate chamber formed in a connecting portion of the front and rear cylinder blocks, the swash plate chamber being capable of receiving refrigerant gas before compression when the refrigerant gas enters therein from the exterior of the compressor;

a drive shaft arranged in the central through-bore and rotatably supported by radial bearings, the drive shaft having a mounting portion thereof extending through the swash plate chamber;

a swash plate mounted on the mounting portion of the drive shaft to be rotated together with the drive shaft in the swash plate chamber and to be axially held by the front and rear cylinder blocks via a pair of axially spaced sliding type thrust bearings;

a plurality of pistons slidably arranged in the axial cylinder bores and operatively engaged with the swash plate via shoes;

front and rear valve plates, each having suction ports and discharge ports formed therein so as to be in registration with the respective axial cylinder bores;

front and rear housings arranged so as to close axial ends of the combined front and rear cylinder blocks via front and rear valve plates, the front and rear housings being fixedly connected to the front and rear cylinder blocks by means of a plurality of axial screw bolts, and each of the front and rear housings having therein a radially inner discharge chamber for compressed refrigerant gas and a radially outer suction chamber for the refrigerant gas before compression;

suction valves held on each of the front and rear valve plates so as to open and close the suction ports in relation to sliding of the plurality of pistons in the axial cylinder bores;

discharge valves held on each of the front and rear valve plates so as to open and close the discharge ports in relation to sliding of the plurality of pistons in the axial cylinder bores;

suction passageway means arranged so as to extend between the swash plate chamber and the suction chambers of the front and rear housings through spaces extending around first predetermined axial screw bolts selected from the plurality of axial screw bolts; and fluidly communicating passageway means arranged so as to provide a fluid communication between the suction passageway means and the central through-bore of the front and rear cylinder blocks to thereby permit a part of the refrigerant gas before compression to flow from the suction passageway means to the central through-bore of the front and rear cylinder blocks.

The radial bearings rotatably supporting the drive shaft may be a pair of front and rear sliding type radial bearings.

Preferably, each of the front and rear valve plates is provided with at least one fluid passageway extending between one of the plurality of axial cylinder bores and the central through-bore of the combined front and rear cylinder blocks so as to provide a fluid communication between one of the plurality of axial cylinder bores and the central through-bore when one of the suction valves associated with the cylinder bore opens the associated suction port.

Each of the sliding type thrust bearings comprises a stationary annular ring and a movable annular ring, the stationary and movable annular rings having coaxial central bores formed therein so as to permit the drive shaft to extend therethrough, the stationary annular ring having a first sliding face, and a second supporting face opposite to the first sliding face and being in contact with the front or rear cylinder block, and the movable annular ring having a first sliding face being in slide contact with the first sliding face of the stationary annular ring, and a second supporting face opposite to the first sliding face and being in contact with the swash plate. The first sliding face of the stationary annular ring is provided with curved grooves formed therein so as to radially extend from the central bore to the circumference of the ring, and being in communication with axial recesses formed in the wall of the central bore.

Preferably, at least one of the first sliding faces of the stationary and movable annular rings of the sliding type thrust bearing is coated with synthetic resin film having a low friction property.

In accordance with a further aspect of the present invention, there is provided a swash plate type refrigerant compressor suitable for being incorporated in a climate control system, which comprises:

a pair of axially combined front and rear cylinder blocks defining therein a central through-bore extending axially, a plurality of axial cylinder bores arranged around the central through-bore, and a swash plate chamber formed in a connecting portion of the front and rear cylinder blocks, the swash plate chamber being capable of receiving refrigerant gas before compression when the refrigerant gas enters therein upon returning from the climate control system;

a drive shaft arranged in the central throughbore and rotatably supported by radial bearings, the drive shaft having a mounting portion thereof extending through the swash plate chamber;

a swash plate mounted on the mounting portion of the drive shaft to be rotated together with the drive shaft in the swash plate chamber and to be axially held by the front and rear cylinder blocks via a pair of axially spaced thrust bearings;

a plurality of pistons slidably arranged in the axial cylinder bores and operatively engaged with the swash plate via shoes;

front and rear valve plates, each having suction ports and discharge ports formed therein so as to be in registration with the respective axial cylinder bores;

front and rear housings arranged so as to close axial ends of the combined front and rear cylinder blocks via front and rear valve plates, the front and rear housings being fixedly connected to the front and rear cylinder blocks by means of a plurality of axial screw bolts, and each of the front and rear housings having therein a radially inner discharge chamber for compressed refrigerant gas and a radially outer suction chamber for the refrigerant gas before compression;

suction valves held on each of the front and rear valve plates so as to open and close the suction ports in relation to sliding of the plurality of pistons in the axial cylinder bores;

discharge valves held on each of the front and rear valve plates so as to open and close the discharge ports in relation to sliding of the plurality of pistons in the axial cylinder bores;

suction passageway means arranged so as to extend between the swash plate chamber and the suction chambers of the front and rear housings through spaces extending around the respective axial screw bolts; and fluid passageway means arranged in each of the front and rear valve plates so as to extend between at least a predetermined one of the cylinder bores and the central through-bore to thereby provide a fluid communication therebetween in synchronism with opening of the suction valve associated with the predetermined cylinder bore.

Preferably, the fluid passageway means includes a plurality of fluid passageways arranged between two or more predetermined cylinder bores of the plurality of cylinder bores and the central through-bore of the front and rear cylinder blocks so as to provide fluid communication between the two or more predetermined cylinder bores and the central through-bore in synchronism with opening of the suction valves associated with the two or more predetermined cylinder bores. The two or more predetermined cylinder bores of the plurality of cylinder bores should preferably not be neighboring cylinder bores.

Preferably, the swash plate type refrigerant compressor is further provided with a discharge pulsation damping chamber unit formed at a predetermined upper portion of the axially combined front and rear cylinder blocks so as to be constantly fluidly communicated with the discharge chambers of the front and rear housings and to be capable of being communicated with the climate control system, the discharge pulsation damping chamber unit having an oil separating unit incorporated therein for separating lubricating oil from the compressed refrigerant gas, and a portion thereof being in constant communication with the swash plate chamber via oil return passageways containing therein flow restricting passageways formed in the axial ends of the axially combined front and rear cylinder blocks.

The discharge pulsation damping chamber unit is provided to have an axially elongated cavity extending through a plane in which combining of the front and rear cylinder blocks is carried out with an intervention of a sealing gasket, and fluidly communicated with the discharge chambers of the front and rear housings via individual discharge gas passageways having end apertures opening toward the elongated cavity. The sealing gasket arranged in the combining plane of the front and rear cylinder blocks is provided with a sheet of oil separating screen element extending in the axially elongated cavity so as to form the oil separating unit. The oil separating screen element of the sealing gasket is arranged so as to face each of the end apertures of the discharge gas passageways to thereby permit the lubricating oil contained in the compressed refrigerant gas to be separated when the flow of the compressed refrigerant gas discharging from the discharge gas passageways impinges upon the screen member. The sheet of oil separating screen element of the sealing gasket is provided with a plurality of through-holes permitting the compressed refrigerant gas to pass therethrough.

The oil return passageways include oil passageway portions extending around second predetermined axial screw bolts selected from the plurality of axial screw bolts, the oil passageway portions of the oil return passageway can function as an oil reservoir having a substantial volume.

Alternately, the swash plate type refrigerant compressor may be provided with a discharge pulsation damping chamber unit formed at an upper portion of the axially combined front and rear cylinder blocks so as to be constantly fluidly communicated with the discharge chambers of the front and rear housings via individual discharge gas passageways and to be capable of being communicated with the climate control system, and an oil reservoir chamber unit formed at a predetermined lower portion of the axially combined front and rear cylinder blocks so as to be fluidly communicated with the swash plate chamber via an oil flow restriction passageway and with the discharge pulsation damping chamber unit via an oil return groove extending through a combined portion of the front and rear cylinder blocks.

BRIEF DESCRIPTION OF THE DRAWINGS

The above and other objects, features, and advantages of the present invention will be made more apparent from the ensuing description of the preferred embodiments thereof with reference to the accompanying drawings wherein.

DESCRIPTION OF THE PREFERRED EMBODIMENTS

Figure 1:
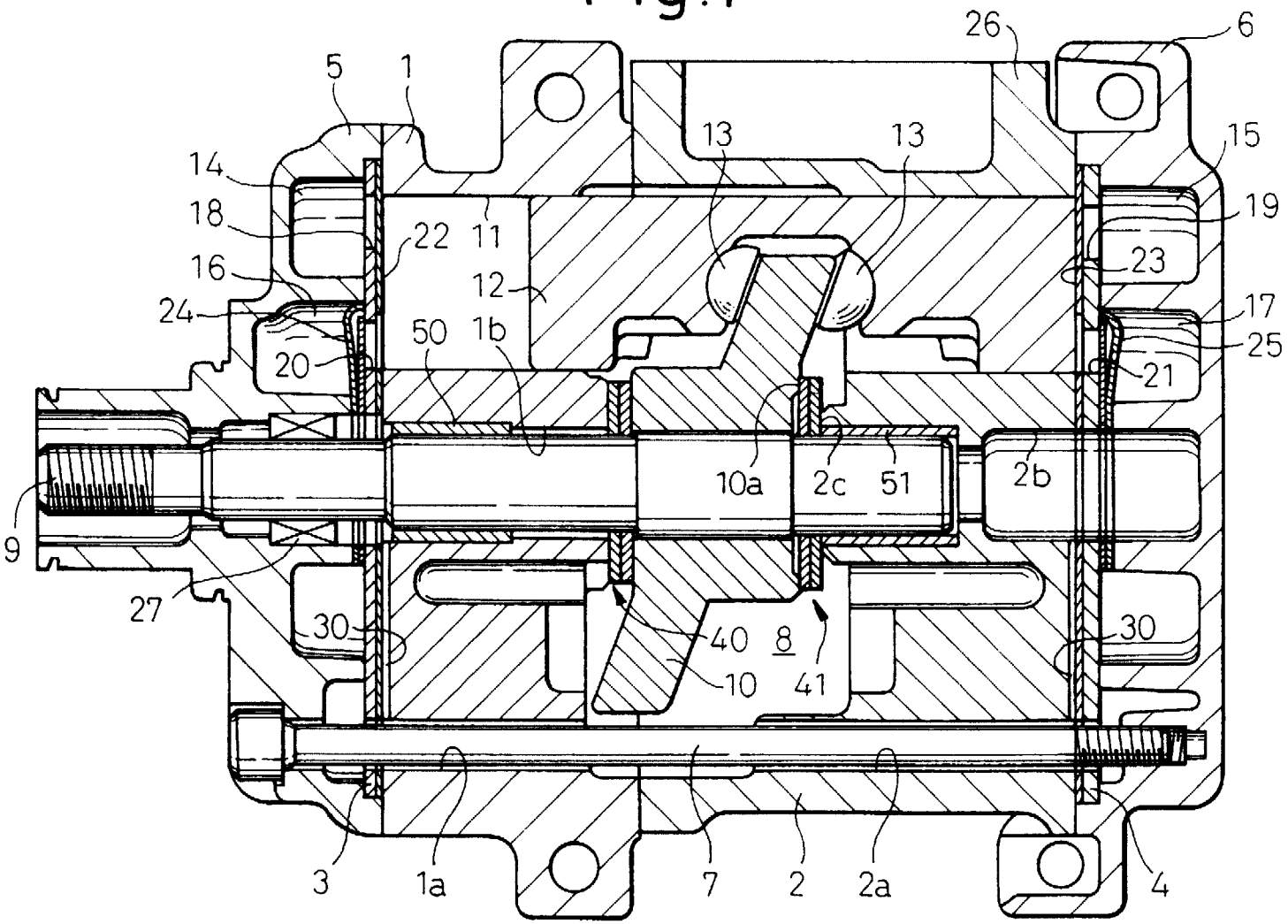
FIG. 1 is a longitudinal cross-sectional view of a swash plate type refrigerant compressor provided with an internal lubricating system according to an embodiment of the present invention.
Figure 2:
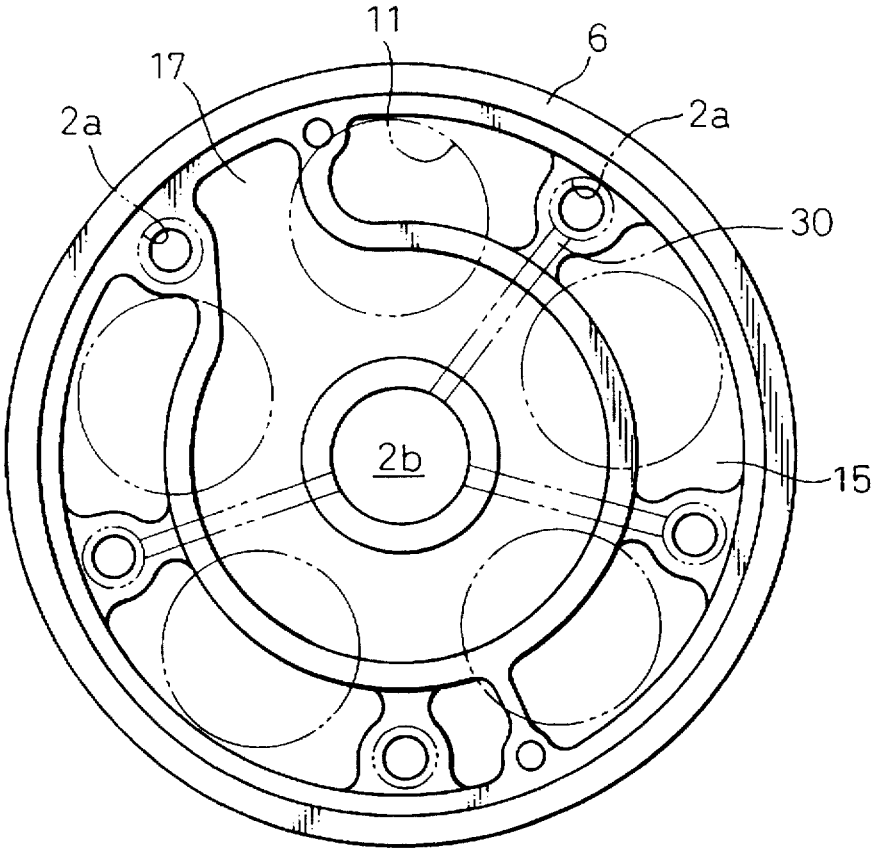
FIG. 2 is a side view of a rear housing of the swash plate type compressor of FIG. 1, illustrating a part of a lubricating system incorporated in the compressor.

FIGS. 1 and 2 illustrate a swash plate type refrigerant compressor having therein a plurality of (five) double-headed pistons reciprocating in front and rear coaxial cylinder bores (five front and five rear cylinder bores). The compressor has front and rear cylinder blocks 1 and 2 which are axially combined together in a face-to-face contact by using later-described screw bolts 7. The axial outer ends of the front and rear cylinder blocks 1 and 2 are closed by front and rear housings 5 and 6 via front and rear valve plates 3 and 4. The front and rear cylinder blocks 1 and 2, the front and rear valve plates 3 and 4, and the front and rear housings 5 and 6 are tightly combined together by a plurality of long axial screw bolts 7 having a front threaded end and a rear head end, respectively. The axial screw bolts 7 are inserted in a plurality of axial through-bores 1*a* and 2*a* formed in the front and rear cylinder blocks 1 and 2, and threadedly engaged in a plurality of screw bores formed in the rear housing 6. The axial through-bores 1*a* and 2*a* are formed so as to provide small annular spaces extending around the respective axial screw bolts 7.

The front and rear cylinder blocks 1 and 2 have a swash plate chamber 8 defined at a substantially middle portion of the axially combined cylinder blocks 1 and 2, and coaxial central through-bores 1*b* and 2*b* extending axially through the center thereof. A drive shaft 9 is inserted in the central through-bores 1*b* and 2*b*, and has a middle mounting portion on which a swash plate 10 is fixedly mounted in a manner such that the swash plate 10 rotates together with the drive shaft 9 within the swash plate chamber 8.

The combined cylinder blocks 1 and 2 also have a plurality of coaxial axially extending cylinder bores 11 formed therein which are arranged around the central through-bores 1*b* and 2*b* so as to be angularly spaced apart from one another and in parallel with the rotating axis of the drive shaft 9. A plurality of double-headed pistons 12 are received in the cylinder bores 11 so as to slidably reciprocate thereby performing suction and compression of refrigerant gas and discharge of the compressed gas. The double-headed pistons 12 are operatively engaged with the swash plate 10 via half-spherical shoes 13.

The front and rear housings 5 and 6 are provided with front and rear suction chambers 14 and 15, respectively, formed in a radially outer portion of both housings 5 and 6 for receiving the refrigerant gas before compression. The front and rear housings 5 and 6 are also provided with front and rear discharge chambers 16 and 17, respectively, formed in a central portion of both housings 5 and 6 for receiving the compressed gas discharged from the cylinder blocks 11. The front and rear valve plates 3 and 4 are provided with a plurality of front and rear suction ports 18 and 19 which permit the refrigerant gas before compression to pass therethrough from the respective suction chambers 14 and 15 into the respective cylinder bores 11, and a plurality of front and rear discharge ports 20 and 21 which permit the compressed refrigerant gas to flow therethrough from the respective cylinder bores 11 into the front and rear discharge chambers 16 and 17. Suction valves 22 and 23 are interposed between the axial ends of the front and rear cylinder blocks 1 and 2 and the respective valve plates 3 and 4, and discharge valves 24 and 25 are interposed between the respective valve plates 3 and 4 and the front and rear housings 5 and 6. Each of the suction valves 22, and 23 may be made of a plurality of conventional reed valves (five reed valves in the present embodiment) formed in an integral sheet-like element. Similarly, each of the discharge valves 24 and 25 may be made of a plurality of conventional reed valves (five reed valves in the present embodiment) formed in an integral sheet-like element.

The rear cylinder block 2 is provided with a mount 26 arranged at an upper portion opening toward the exterior of the compressor. The mount 26 is provided for being connected to a flange member (not shown in FIGS. 1 and 2), and has an inlet port (not shown) formed therein to introduce the refrigerant gas from an exterior refrigerating or climate control system into the swash plate chamber 8, and an outlet port (not shown) formed therein to deliver the compressed refrigerant gas toward the refrigerating or climate control system.

The axial through-bores 1*a* and 2*a* of the front and rear cylinder blocks 1 and 2 arranged for insertion of the screw bolts 7 axially extend through the front and rear valve plates 3 and 4 so as to communicate with the front and rear suction chambers 14 and 15. The axial through-bores 1*a* and 2*a* also communicate with the swash plate chamber 8. Thus, the plurality of axial through-bores 1*a* and 2*a* function as gas inlet passageways providing fluid communication between the swash plate chamber 8 and the front and rear suction chambers 14 and 15. Therefore, the refrigerant gas entering the swash plate chamber 8 from the above-mentioned inlet port flows from the swash plate chamber 8 toward the front and rear suction chambers 14 and 15 via the axial through-bores 1*a* and 2*a* functioning as the inlet passageways.

The outlet port of the mount 26 for delivering the compressed refrigerant gas is communicated with the front and rear discharge chambers 16 and 17 via discharge passageways (not shown) formed in the front and rear cylinder blocks 1 and 2 at positions between two respective neighboring cylinder bores 11.

The front housing 5 has a central through-bore coaxial with the central through-bores 1*a* and 2*a* of the cylinder blocks 1 and 2 so that a front portion of the drive shaft 9 extends through the central through-bore so as to be connected to a suitable rotary drive source means such as an automobile engine via an appropriate rotation transmitting unit (not shown). A shaft seal unit 27 mounted on a part of the front portion of the drive shaft 9 is arranged in the central through-bore of the front housing 5 so as to isolate the interior of the compressor from the exterior thereof.

The drive shaft 9 is rotatably supported by front and rear radial bearings 50 and 51 which are slide type radial bearings, each consisting of a collar made of bearing material.

The swash plate 10 mounted on the drive shaft 9 is provided with a central boss portion axially supported by a pair of thrust bearings 40 and 41 which are interposed between axial inner ends of the front and rear cylinder blocks 1 and 2 and the boss of the swash plate 10. The thrust bearings 40 and 41 are sliding type thrust bearings having substantially the same construction as described later with reference to FIGS. 5A and 5B. The sliding type thrust bearing can be a less expensive mechanical element due to its simple construction assembled by the smallest possible number of components.

The front thrust bearing 40 is stably and rigidly interposed between planar thrust receiving seats of the above-mentioned axial inner end of the front cylinder block 1 and of the boss portion of the swash plate 10. The front thrust bearing 40 includes a pair of annular ring members having a substantial radial width as is understood from the illustration of FIG. 1.

The rear thrust bearing 41 including a pair of similar annular ring members is interposed between an annular pressure receiving land 2*c* formed in the axial inner end of the rear cylinder block 2 and an annular pressure receiving land 10*a* formed in the boss portion of the swash plate 10. Namely, the thrust bearing 41 is held between the swash plate 10 and the rear cylinder block 2 in such a manner that the annular ring members of the bearing 41 can be minutely deformed due to holding of the annular ring members by the land 10*a* having a large diameter and the land 2*c* having a smaller diameter. Thus, the thrust bearing 41 can absorb an axial thrust load acting on the swash plate 10 during the operation of the compressor.

Figure 5A:
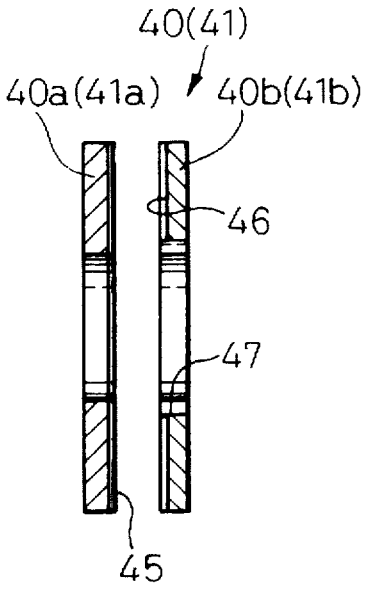
FIG. 5A is a cross-sectional view of a sliding type thrust bearing provided with a stationary annular member and movable annular member, according to the present invention.
Figure 5B:
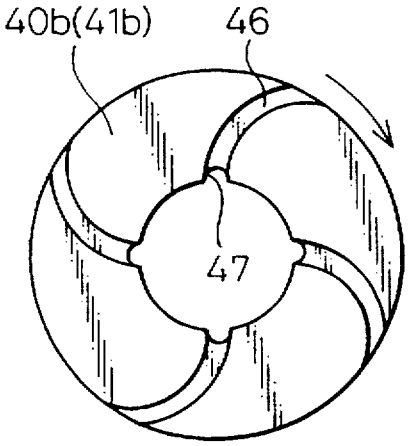
FIG. 5B is a front view of the sliding face of the stationary annular member of the thrust bearing of FIG. 5A.

As best shown in FIGS. 5A and 5B, each of the thrust bearings 40 and 41 includes a pair of centrally bored annular ring members 40*a* (41*a*) and 40*b* (41*b*) which are arranged to be in face-to-face contact with one another when they are assembled between the swash plate 10 and the front or rear block 1 or 2 of the compressor.

The ring member 40*b* or 41*b* is arranged to be in contact with the planar pressure receiving seat of the front cylinder block 1 or the annular pressure receiving land 2*c* of the rear cylinder block 2, and is stationarily held in place. Thus, the annular ring member 40*b* or 41*b* can be referred to as a stationary annular ring member. The annular ring member 40*a* or 41*a* is arranged to be in contact with the planar pressure receiving seat or the annular pressure receiving land 10*a* of the boss portion of the swash plate 10, and is rotatably held in place. Thus, the annular ring member 40*a* or 41*a* can be referred to as a movable annular member. The movable annular ring member 40*a* or 41*a* has a sliding face coated with a low-friction synthetic resin film 45 such as a film of fluorocarbon polymers. The stationary annular ring member 40*b* or 41*b* has a sliding face formed with a plurality of (e.g., four) curved grooves 46 which generally radially extend from the central bore of the stationary annular ring member 40b or 41b. The inner ends of the respective curved grooves 46 are connected to axial recesses 47 formed in the wall of the central bore of the stationary annular ring member 40b or 41b. These curved grooves 46 and the axial recesses 47 are provided for supplying the sliding faces of both stationary and movable annular ring members of the two sliding type thrust bearings 40 and 41 with a sufficient amount of lubricating oil during the operation of the compressor, in a manner described later.

It should be appreciated that the sliding type radial bearings 50 and 51 rotatably supporting the drive shaft 9 can also be a less expensive mechanical element, and are provided with a plurality of axial oil recesses formed in the inner wall of the bearing bore for easily introducing lubricating oil therein.

The description of the internal lubricating unit of the compressor will be provided below with reference to FIGS. 2 through 4, typically illustrating the constructions provided for the rear side of the compressor. It should be understood that since a similar construction is also provided for the front side of the compressor, a similar advantageous operation can be obtained on the front side of the compressor.

Referring first to FIG. 2, the axial end of the rear cylinder block 2 is provided with one or more narrow passageways 30 (three passageways in the present embodiment) recessed therein so as to provide fluid communication between the gas inlet passageways formed by the axial through-bores 1a and 2a, and the central through-bores 1b and 2b of the front and rear cylinder blocks 1 and 2. The narrow passageways 30 are arranged so as to construct lubrication-purpose passageways branching from the gas inlet passageways and routing a part of the refrigerant gas before compression containing therein lubricating oil from the gas inlet passageways into the central through-bores 1b and 2b. At this stage, the provision of the passageways 30 is not limited to the axial end of the rear cylinder block 2, and the passageways 30 may alternately be provided in either the surface of the rear valve plate 4 or both of the axial end of the rear cylinder block 2 and the surface of the rear valve plate 4.

In accordance with the internal lubricating unit of the compressor shown in FIG. 2, when the compressor is started to operate by the application of a rotary drive force to the drive shaft 9, the refrigerant gas returning from the external refrigerating or climate control system enters the swash plate chamber 8, and further flows toward the suction chambers 14 and 15 via the gas inlet passageways formed by the axial through-bores 1a and 2a of the front and rear cylinder blocks 1 and 2. However, a part of the refrigerant gas before compression flowing in the axial through-bores 1a and 2a flows into the coaxial central through-bores 1b and 1b of the front and rear cylinder blocks 1 and 2 as a branch flow of the refrigerant gas. The branch refrigerant gas flowing in the central through-bores 1b and 2b further flows into the swash plate chamber 8, via minute gaps provided among respective components of the thrust and radial bearings 40, 41, 50 and 51. The branch flow of the refrigerant gas occurs for the reason that in the swash plate chamber 8, the refrigerant gas before compression having returned from the external climate control system tends to flow through a radially outer region rather than a radially inner region of the swash plate chamber 8 while causing a pressure differential between the radially outer and inner regions of the swash plate chamber 8. Namely, the pressure differential acts so as to draw the part of the refrigerant gas before compression from the central through-bores 1b and 2b into the swash plate chamber 8. Further, a centrifugal effect due to rotation of the swash plate 10 and of the thrust bearings 40 and 41 can promote the branch flow of the refrigerant gas to enter from the central through-bores 1b and 2b into the swash plate chamber 8. Thus, the branch flow of the refrigerant gas containing therein lubricating oil passes through the axial oil grooves of the bearing bores of the sliding type radial bearings 50 and 51, and the curve grooves 46 and the axial recesses 47 of the two respective sliding type thrust bearings 40 and 41. Therefore, the sliding type radial and thrust bearings 50, 51, 40, and 41 can be successfully lubricated by the lubricating oil contained in the refrigerant gas of the branch flow. Further, the shaft seal unit 27 on the front portion of the drive shaft 9 can also be lubricated.

Still further, when the branch flow of the refrigerant gas advances from the narrow passageways 30 into the central through-bore 2b having a larger cross-sectional area compared with the area of the narrow passageways 30 on the rear side of the compressor, the refrigerant gas is quickly expanded to cause separation of the lubricating oil from the gas. Also, when the branch flow of the refrigerant gas impinges upon the end of the drive shaft 9, the lubricating oil is again separated from the gas. Therefore, the separated lubricating oil remains in the central through-bores 1b and 2b around the radial and thrust bearings 50, 51, 40, and 41 and the shaft seal unit 27, and accordingly, can sufficiently lubricate these elements.

The sliding type thrust bearings 40 and 41 thus lubricated can smoothly rotate under a substantial axial load applied thereto during the operation of the compressor. Since the low frictional resin coat 45 is provided on the sliding surface of the movable annular ring member 40a or 41a, and since the curved grooves 46 of the stationary annular ring member 40b or 41b are formed so as to curve in a direction shown by an arrow (see FIG. 5B) in association with the rotating direction of the drive shaft 9, smooth sliding motion of the stationary and movable annular ring members 40a (41a) and 40b (41b) of the thrust bearings 40 and 41 can be effectively obtained.

Figure 3:
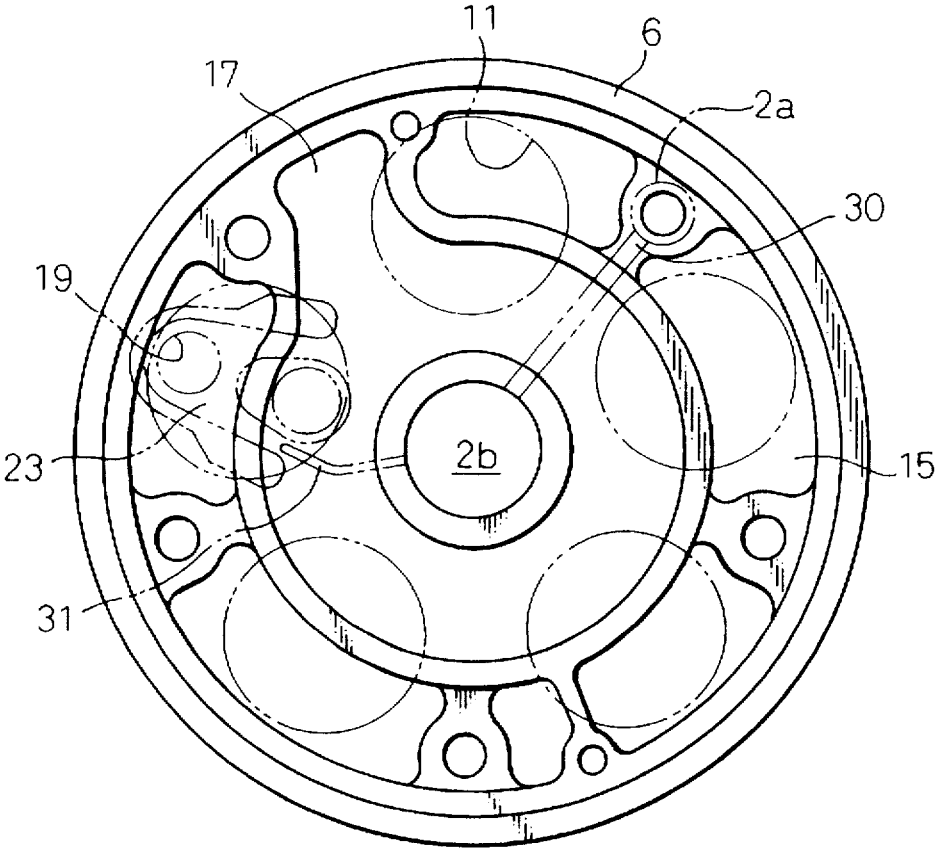
FIG. 3 is a similar side view of a rear housing of a swash plate type refrigerant compressor, illustrating a different lubricating system incorporated in the compressor.
Figure 4:
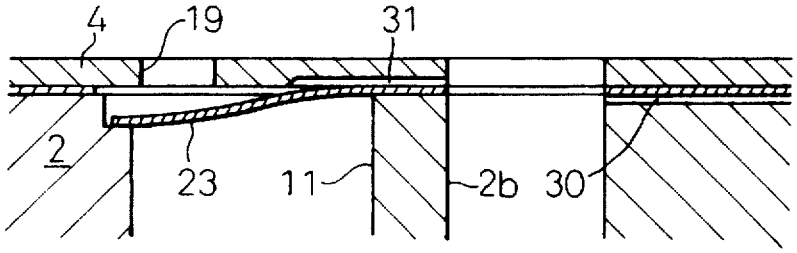
FIG. 4 is an enlarged partial cross-sectional view of the same lubricating system as that illustrated in FIG. 3.

FIGS. 3 and 4 schematically illustrate a different internal lubricating system adapted for being incorporated in the swash plate type compressor of FIG. 1, which is modified from and improved over the embodiment shown in FIG. 2. Although the construction of the internal lubricating system shown in FIGS. 3 and 4 is related to only the rear side of the compressor, a similar construction is provided on the front side of the compressor.

In the internal lubricating unit of the embodiment of FIGS. 3 and 4, the valve plates 3 and 4 are provided with fluid passageways 31 formed therein so as to extend between one or more cylinder bores 11 and the coaxial central through-bores 1b and 2b of the front and rear cylinder blocks 1 and 2, and to provide a fluid communication therebetween in synchronism with opening of the front and rear suction valves 22 and 23.

The central through-bores 1b and 2b are also constantly communicated with the gas inlet passageways formed by the axial through-bores 1a and 2a via the narrow passageways 30 in the same way as the embodiment of FIG. 2. Therefore, when the central through-bores 1 and 2b fluidly communicate with the cylinder bores 11 via the fluid passageways 31 due to intermittent opening of the suction valves 22 and 23, pressure in the central through-bores 1b and 2b is correspondingly lowered, and accordingly, the branch flow of the refrigerant gas before compression is periodically pumped from the gas inlet passageways (the axial through-bores 1a and 2a) into the central through-bores 1b and 2b via the fluid passageways 31. Thus, the central through-bores 1b and 2b can be supplied with the lubricating oil contained in the branch flow of the refrigerant gas before compression in a more positive manner than with the embodiment described with reference to FIG. 2. Accordingly, the lubrication of the sliding type thrust and radial bearings 40, 41, 50, and 51 can be ensured. Thus, the number of annular ring members of the sliding type thrust bearings 40 and 41 may be increased so that an additional annular ring member or members may be interposed between the stationary and movable annular ring members 40*a*(41*a*) and 40*b*(41*b*) so as to increase the mechanical rigidity of the thrust bearings 40 and 41.

A further embodiment of the swash plate type refrigerant compressor provided with an internal lubricating system is illustrated in FIGS. 6 through 13. However, since the basic construction and operation of the compressor for compressing refrigerant gas and delivering the compressed refrigerant gas is substantially the same as that of the compressor shown in FIG. 1. Therefore, the same and similar elements and parts are designated by the same reference numerals throughout FIGS. 6 through 13. Nevertheless, the shape and the internal construction of the front and rear cylinder blocks and the front and rear housings are somewhat different from those of the compressor of FIG. 1. Thus, different reference numerals 61, 62, 65, and 66 are used for designating the front and rear cylinder blocks and the front and rear housings.

The front and rear cylinder blocks 61 and 62 and the front and rear housings 65 and 66 are axially hermetically combined together by using the long screw bolts 7. The front and rear valve plates 3 and 4 are interposed between the front cylinder block 61 and the front housing 65 and between the rear cylinder block 62 and the rear housing 66. The front and rear cylinder blocks 61 and 62 have a swash plate chamber 8, central coaxial through-bores 1*b* and 2*b*, and a plurality of (five) cylinder bores 11 arranged around the central through-bores 1*b* and 2*b*. The front and rear cylinder blocks 61 and 62 further have a later-described described discharge pulsation damping chamber 63 and a later-described oil reservoir 80. It should be understood that the arrangements of a drive shaft 9, a swash plate 10, shoes 13, a shaft seal unit. 27, front and rear suction ports 18 and 19, front and rear suction valves-22 and 23, front and rear discharge ports 20 and 21, front and rear discharge valves 24 and 25, the sliding type thrust bearings 40 and 41 for axially supporting the swash plate 10, the sliding type radial bearings 50 and 51 for radially supporting the drive shaft 9, front and rear suction chambers 14 and 15, and front and rear discharge chambers 16 and 17 are substantially the same as those of the compressor of FIG. 1, and therefore, a detailed description of the arrangements is not provided here to avoid repetition.

In the compressor of FIGS. 6 through 13, a plurality of axial through-bores 1*a* and 2*a* are provided in the axially combined front and rear cylinder blocks 61 and 62 and the front and rear valve plates 3 and 4 so as to have a bore diameter larger than the diameter of the long screw bolts 7, and are used for two different functions in addition to the function for inserting therein the long screw bolts 7 to tightly combine the cylinder blocks 61, 62, and the housings 65, 66. Namely, some of the plurality of axial through-bores 1*a* and 2*a* are used as gas inlet passageways for permitting the refrigerant gas before compression to flow from the swash plate chamber 8 toward the respective suction chambers 14 and 15 when the refrigerant gas returns from an exterior climate control or refrigerating system and enters the swash plate chamber 8 via an inlet port (not shown).

The remaining axial through-bores 1*a* and 2*a*, i.e., two axial through-bores 1*a* and 2*a* in the present embodiment, are used for constructing a part of oil passageways of the internal lubricating system described below.

The description of the internal lubricating system incorporated in the swash plate-type refrigerant compressor is provided below.

Figure 7:
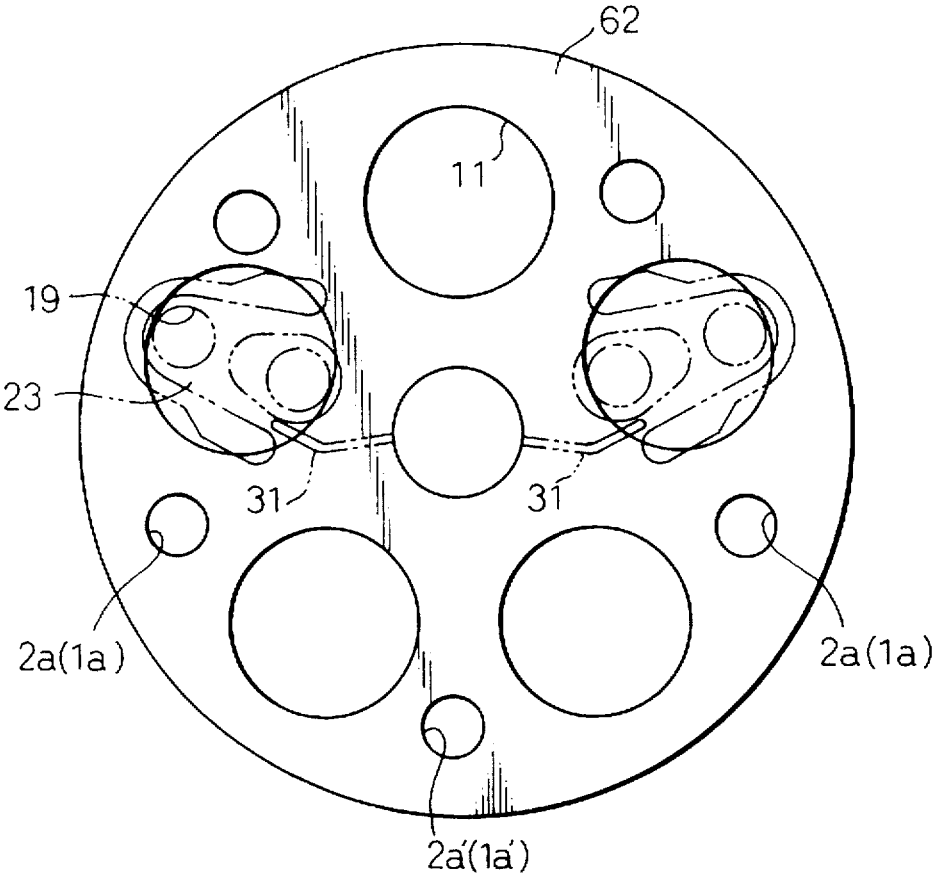
FIG. 7 is a schematic end view of a rear cylinder block of the compressor, taken along the line VI—VI of FIG. 6, illustrating an arrangement for providing fluid communication between cylinder bores and a central through-bore for receiving a drive shaft of the compressor.
Figure 8:
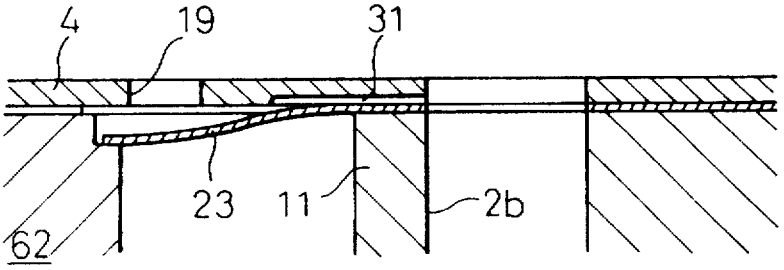
FIG. 8 is an enlarged partial cross-sectional view of the end portion of the rear cylinder block, illustrating a part of the internal lubricating system of the compressor.

Referring, in particular, to FIGS. 7 and 8, each of the front and rear valve plates 3 and 4, typically the rear valve plate 4 is provided with fluid passageways 31 which are arranged so as to provide a fluid communication between some of the cylinder bores 11 (two cylinder bores in the present embodiment) and the central bores 1*b* and 2*b* of the front and rear cylinder blocks 61 and 62 in synchronism with opening of the rear suction valves 23. The open position of one of the rear suction valves 23 is shown in FIG. 8. The fluid communication between each of the cylinder bores 11 and the central through-bores 1*b* and 2*b* causes reduction in pressure in the central through-bores 1*b* and 2*b* due to the fact that the cylinder bore 11 opened by the suction valves 23 is in the suction phase for suction of the refrigerant gas before compression from the rear suction chamber 15. When the pressure in the central through-bores 1*b* and 2*b* is reduced, a part of the refrigerant gas before compression received in the swash plate chamber 8 is directly pumped therefrom into the central through-bores 1*b* and 2*b* of the front and rear cylinder blocks 61 and 62 by a pressure differential between the central through-bores 1*b* and 2*b* and the swash plate chamber. It should be noted that the cylinder bores 11 communicated fluidly with the central through-bores 1*b* and 2*b* via the fluid passageways 31 should not be the neighboring cylinder bores. Since the refrigerant gas received in the swash plate chamber 8 contains lubricating oil, the central through-bores 1*b* and 2*b* are supplied with the lubricating oil, and therefore, the lubricating oil in the central through-bores 1*b* and 2*b* lubricates the sliding type thrust bearings 40 and 41, the sliding type radial bearings 50 and 51, and the shaft seal unit 27.

The swash plate type refrigerant compressor of the present embodiment is also provided with an oil separating unit incorporated therein which can contribute to effective lubrication of the compressor. Namely, the compressor is provided with the afore-mentioned discharge pulsation damping chamber 63 which is arranged at an upper portion of the axially combined cylinder blocks 61 and 62. The damping chamber 63 has an axially elongated cavity enclosed by wall portions integral with the front and rear cylinder blocks 61 and 62. The damping chamber 63 includes a front damping chamber portion 63a and a rear damping chamber portion 63*b* which fluidly communicate with the front and rear discharge chambers 16 and 17, respectively, via individual gas passageways 32*a* and 32*b* having end apertures opening toward the front and rear damping chamber portions 63*a* and 63*b*.

The discharge pulsation damping chamber 63 is also fluidly connected to the exterior climate control system via an outlet port 33 which is provided in the wall portion enclosing the rear damping chamber portion 63*b*. Generally, appropriate pipe or conduits are used for connecting the compressor and the climate control system.

A sealing gasket 67 in the form of an annular ring-like element is arranged in the front and rear cylinder blocks 61 and 62 at a position where the two cylinder blocks are axially connected to each other to hermetically seal the connected portion of both cylinder blocks 61 and 62. The sealing gasket 67 is used for forming the above-mentioned front and rear separate damping chambers 63*a* and 63*b* within the chamber 63. Namely, the sealing gasket 67 has a flat extension functioning as an oil separating screen element 67*a* shown best in FIGS. 9 and 11. The screen element 67*a* has a half portion thereof arranged at an axially intermediate position between the end apertures of the gas passageways 32*a* and 32*b*, and the remaining half portion having a plurality of apertures 68 (six round apertures in the shown embodiment) formed therein so as to provide fluid communication between the front and rear damping chambers 63*a* and 63*b*. The oil separating screen element 67*a* functions so as to separate the lubricating oil from the refrigerant gas when the refrigerant gas containing therein the lubricating oil impinges on both faces of the oil separating screen element 67*a* as shown by arrows in FIG. 11. The separated lubricating oil remains in the front and rear damping chambers 63*a* and 63*b*, and the refrigerant gas is delivered therefrom toward the exterior climate control system via the afore-mentioned outlet port 33.

Figure 6:
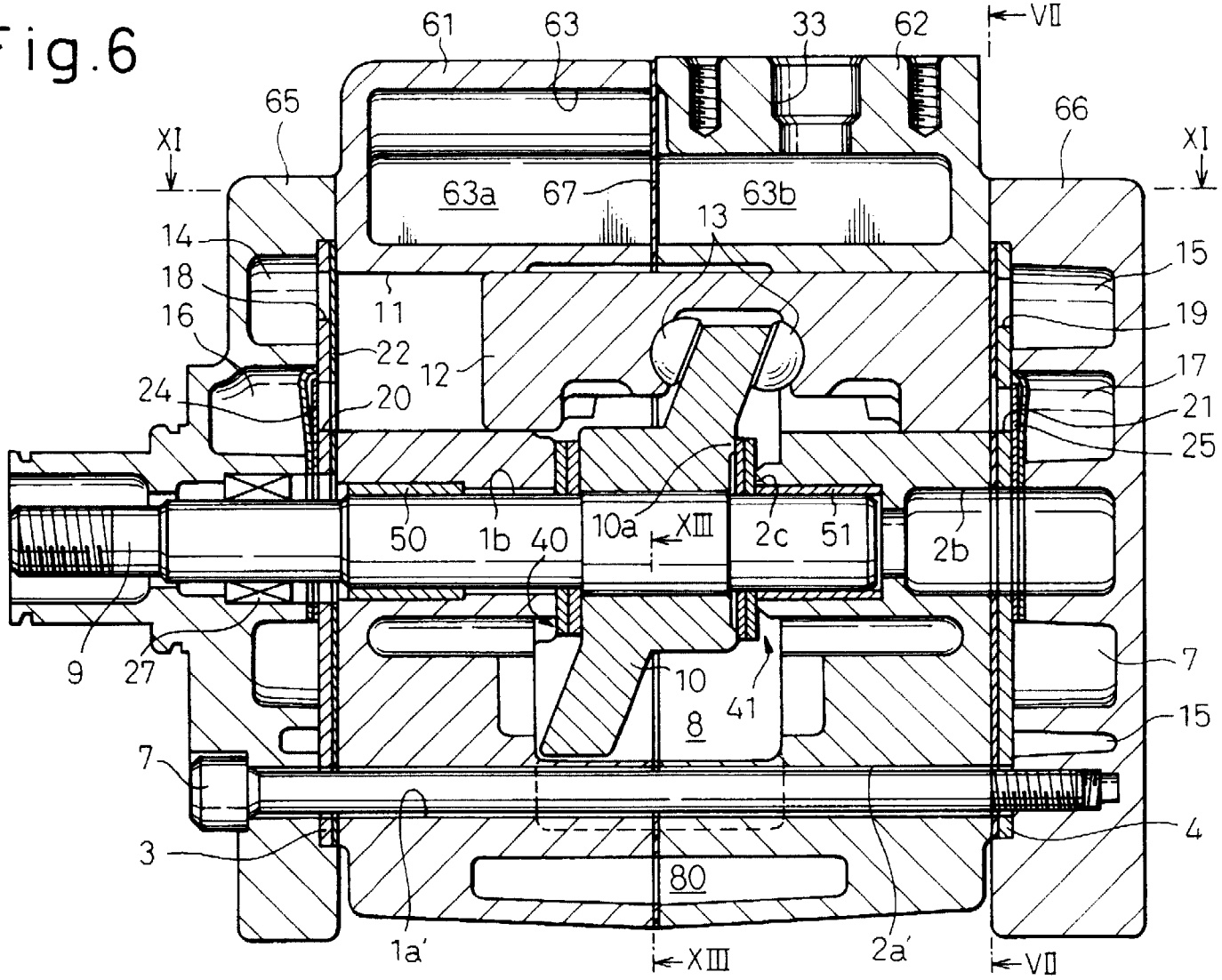
FIG. 6 is a longitudinal cross-sectional view of a swash plate type refrigerant compressor provided with an internal lubricating system according to another embodiment of the present invention.
Figure 9:
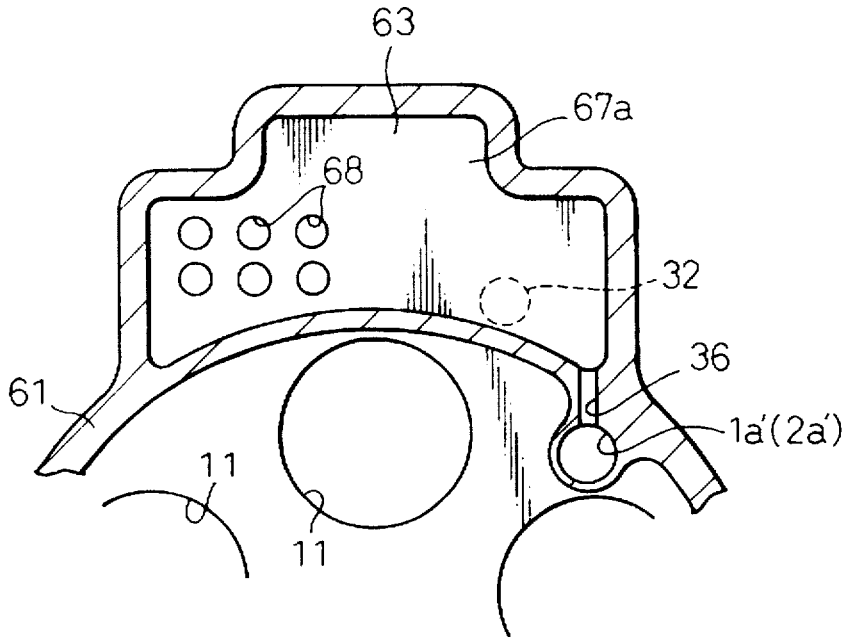
FIG. 9 is a schematic partial cross-sectional view of a discharge pulsation damping chamber unit and an oil separating screen element provided at an upper portion of the axially combined cylinder front and rear blocks, particularly at a position where the front and rear cylinder blocks are combined.
Figure 12:
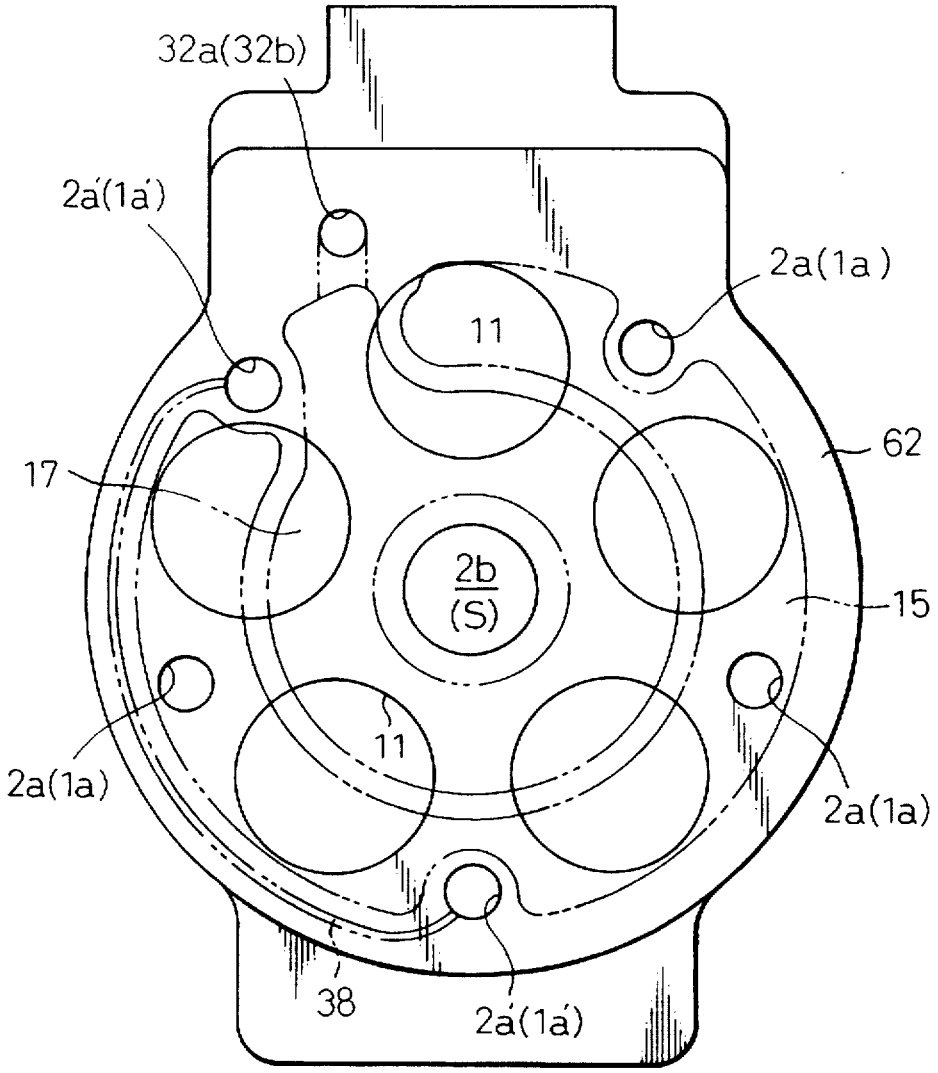
FIG. 12 is a schematic end view of a rear cylinder block of the compressor of FIG. 6, illustrating a fluid flow restriction passageway formed in the end of the rear cylinder block; and, FIG. 13 is a partial end view of a front cylinder block, taken along the line XIII—XIII of FIG. 6, viewing from a position where the front and rear cylinder blocks are combined together, and illustrating an oil reservoir formed in a lower portion of the axially combined front and rear cylinder blocks.

The discharge pulsation damping chamber 63 is provided with a curved bottom surface shown in FIG. 9 which has a pair of oil return apertures 36 formed at a connecting position of the front and rear damping chambers 63*a* and 63*b*. The pair of oil return apertures 36 are fluidly connected to the axial through-bores 1*a* and 2*a* functioning as the afore-mentioned oil passageways designated by reference numerals 1*a*' and 2*a*'. The oil passageways 1*a*' and 2*a*' are fluidly isolated from the swash plate chamber 8 and the front and rear suction chambers 14 and 15. In the present embodiment, the oil return apertures 36 are directly connected to one of the two axial oil passageways 1*a*' and 2*a*', which is located in the upper portion of the axially combined cylinder blocks 61 and 62, and adjacent to the curved bottom surface of the damping chambers 63*a* and 63*b* as shown in FIG. 9. It should be understood that the upper oil passageways 1*a*' and 2*a*' adjacent to the curved bottom surface of the discharge pulsation damping chamber 64 are fluidly connected to the other oil passageways 1*a*' and 2*a*' located in the lower portion of the axially combined cylinder blocks 61 and 62. The upper and lower oil passageways 1*a*' and 2*a*' are designed to have a substantial volume effective for constantly holding a given amount of lubricating oil therein, and are fluidly connected to one another via narrow passageways 38 to form a continuous oil return passageway leading the lubricating oil into the swash plate chamber as shown in FIGS. 6 and 12. The narrow passageways 38 are formed in the axial ends of the axially combined cylinder blocks 61 and 62. Alternately, A single narrow passageway 38 may be formed in the sealing gasket 67 interposed between the front and rear cylinder blocks 61 and 62. The narrow passageway 38 is arranged so as to function as a flow restriction or flow adjusting unit provided in the oil return passageway. Namely, the narrow passageway 38 functions to generate a constant return flow of the lubricating oil during the operation of the compressor. Further, the narrow passageway 38 can prevent the compressed refrigerant gas from directly returning from the discharge pulsation damping chamber 63 into the swash plate chamber 8 via the oil return passageway even when a shortage of the lubricating oil occurs in the oil return passageway. That is to say, the narrow passageways 38 acts as a sort of check valve in the oil return passageway.

In the above-described swash plate type refrigerant compressor, when the compressing operation is started by the rotation of the drive shaft 9, the compressed refrigerant gas discharged from the cylinder bores 11 into the discharge chambers 16 and 17 is further brought into the discharge pulsation damping chamber 63 via the gas passageways 32*a* and 32*b*. Namely, the compressed refrigerant gas is spouted in the front and rear damping chambers 63*a* and 63*b* from the end apertures of the gas passageways 32*a* and 32*b* and impinges upon the opposite faces of the oil separating screen element 67*a* arranged in the intermediate position of the axially elongated damping chambers 63. Therefore, the lubricating oil component contained in the compressed refrigerant gas is effectively separated from the refrigerant gas due to a difference in the flowing inertia and specific gravity between gas and oil. The separated lubricating oil flows down on the surfaces of the oil separating element 67*a* toward the bottom surface of the damping chambers 63*a* and 63*b*.

Figure 11:
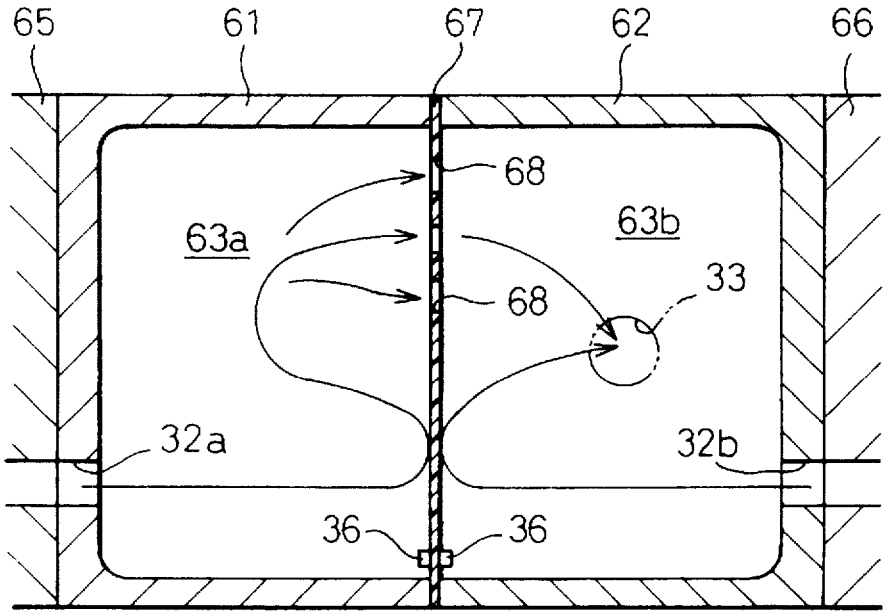
FIG. 11 is a cross-sectional view of the discharge pulsation damping chamber unit and the oil separating screen, taken along the line XI—XI of FIG. 6.

The refrigerant gas in the rear damping chamber 63*b* flows directly toward the outlet port 33 as shown in FIG. 11, and the refrigerant gas in the front damping chamber 63*a* also flows toward the outlet port 33 while passing through the apertures 68 formed in the oil separating screen element 67*a* as also shown in FIG. 11. It should be understood that the discharge pulsation of the refrigerant gas is damped within the two damping chambers 63*a* and 63*b* before the refrigerant gas flows toward the outlet port 33 through which the compressed refrigerant gas is delivered to the exterior climate control system.

Figure 10:
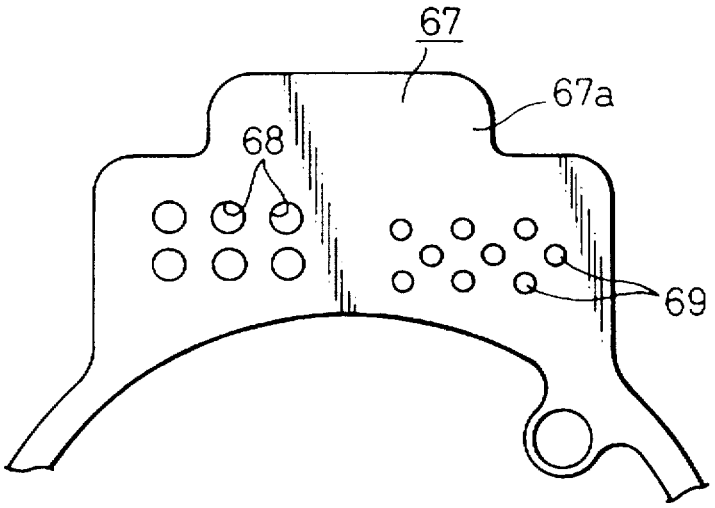
FIG. 10 is a schematic partial front view of an oil separating screen, illustrating a variation from the oil separating screen element of FIG. 9.

The oil separating screen element 67*a* may be additionally provided with a plurality of small apertures or slits 69 as shown in FIG. 10. The provision of these small apertures 69 causes an encounter of the flows of the refrigerant gas discharged from the two opposite gas passageways 32*a* and 32*b* into the front and rear damping chambers 63*a* and 63*b* and accordingly, separating of lubricating oil from the refrigerant gas is promoted. Further, when the refrigerant gas containing therein the lubricating oil flows through the small apertures 69 of the oil separating sceen element 67*a*, it is subjected to flow resistance, and therefore, separation of the lubricating oil from the refrigerant gas is again promoted.

The separated lubricating oil on the bottom surface of the discharge pulsation damping chamber 63 enters the upper oil passageways 1*a*' and 2*a*', via the oil return apertures 36, and is temporarily held there. Subsequently, the lubricating oil further flows into the narrow passageways 38, and is converted to a restricted flow of the lubricating oil therein. The restricted flow of the lubricating oil further flows into the lower oil passageways 1*a*' and 2*a*', and is returned to the swash plate chamber 8.

The lubricating oil in the swash plate chamber 8 is again mixed with the refrigerant gas returning from the climate control system due to agitation by the rotating swash plate 10. Thus, the refrigerant gas containing the lubricating oil therein is then drawn into the central through-bores 1*b* and 2*b* for the drive shaft 9. Thus, the sliding type radial and thrust bearings in the central through-bores 1*b* and 2*b* are properly lubricated. The lubricating oil also lubricates the shaft sealing unit 27.

Figure 13:
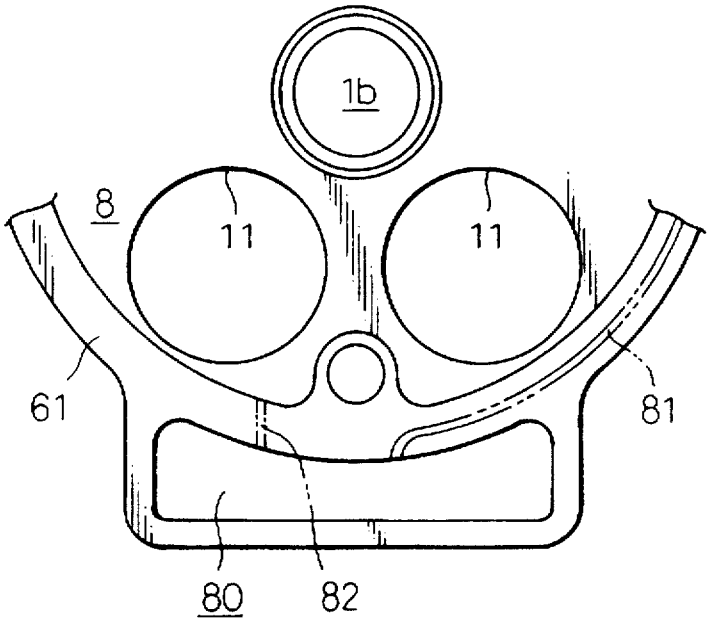

As shown in FIGS. 1 and 13, the swash plate type refrigerant compressor may be further provided with an oil reservoir chamber 80 arranged in the lowermost portion of the axially combined cylinder blocks 61 and 62 at a position below the swash plate chamber 8. The oil reservoir chamber 80 in the form of a simple shallow cavity is fluidly connected to the curved bottom surface of the discharge pulsation damping chamber 63 via an oil hole (not shown) formed in the sealing gasket 67 at a position thereof contiguous with the bottom surfaces of both front and rear damping chambers 63*a* and 63*b*, and a further oil return passageway 81 formed in the face of the sealing gasket 67 so as to have one end continuing to the above-mentioned oil hole and the other end opening into the oil reservoir chamber 80 as shown in FIG. 13. The oil reservoir chamber 80 and the swash plate chamber 8 are communicated by a short restricting passageway 82 formed in the lower portion of the sealing gasket 67, as shown in FIG. 13.

Thus, the lubricating oil separated by the oil separating screen element 67*a* from the refrigerant gas and held in the front and rear damping chamber 63*a* and 63*b* can be brought into the oil reservoir chamber 80 via the oil return passageway 81, and is stored therein. The lubricating oil in the reservoir chamber 80 is gradually supplied into the swash plate chamber 8 by a pressure differential between both chambers 8 and 80 while being restricted by the short restricting passageway 82. The lubricating oil supplied into the swash plate chamber 8 is mixed with refrigerant gas within the swash plate chamber 8 and is drawn into the central through bores 1*b* and 2*b*, and lubricates the thrust and radial bearings 40, 41, 50 and 51. The provision of the oil reservoir chamber 80 ensures the storing of lubricating oil within the compressor body, and therefore, can prevent shortage of lubricating oil in the interior of the compressor for a long operation life of the swash plate type refrigerant compressor.

In one variation, the above-mentioned oil return passageway 81 may be arranged in the axial ends of the front and rear cylinder blocks 61 and 62 so that the passageway 81 extends from the upper oil passageways 1*a*' and 2*a*' toward the oil reservoir chamber 80 via the lower oil passageways 1*a*' and 2*a*'.

From the foregoing description of the several preferred embodiments of the present invention, it will be understood that in accordance with the technical concept of the present invention, the interior of a swash plate type refrigerant compressor, especially radial and thrust bearings and a shaft seal which are subjected to substantial high rotating speed and axial loads for a long operation life of the compressor can be constantly and properly lubricated by the lubricating oil contained in the refrigerant gas. Further, the thrust and radial bearings incorporated in the compressor can be simple and low price sliding type thrust and radial bearings. Still further, according to the present invention, the separation of the lubricating oil from the refrigerant gas and the storing of the lubricating oil are adequately associated with one another, and accordingly, an effective use of a substantially reduced amount of lubricating oil mixed with the refrigerant gas can be achieved.

Although the described embodiments are related to a swash plate type double-headed-piston refrigerant compressor, the present invention can be equally applied to a refrigerant compressor having axially reciprocating pistons driven by a cam-plate other than a swash plate. Further, many modifications and variations from the described embodiments of the present invention will occur to persons skilled in the art without departing from the spirit and scope of the invention claimed in the accompanying claims.

What we claim:

1. A refrigerant compressor incorporated in a climate control system for implementing compression of a refrigerant gas containing therein lubricating oil, comprising:

a suction chamber means for the refrigerant gas before compression;

a discharge chamber means for the refrigerant gas after compression;

an operating chamber means having a variable volume chamber therein varying between a first predetermined volume position and a second reduced volume position, the variable volume chamber of said operating chamber means receiving therein the refrigerant gas from said suction chamber means during a volume expanding phase varying the volume thereof to said first predetermined volume position, and compressing the refrigerant gas during a volume reducing phase varying the volume thereof from said first predetermined volume position to said second reduced volume position;

a compressing-operation-drive means for driving said operating chamber means to alternately vary the volume thereof between the first predetermined volume position and the second reduced volume position;

a suction port means for providing a fluid communication between said suction chamber means and the variable volume chamber of said operating chamber means;

a discharge port means for providing a fluid communication between said discharge chamber means and the variable volume chamber of said operating chamber means;

a suction valve means for opening and closing said suction port means, said suction valve means opening said suction port means during said volume expanding phase of said operating chamber means to thereby allow the refrigerant gas before compression to flow from said suction chamber means into said operating chamber means; and a lubricating oil passageway means for permitting the refrigerant gas containing therein the lubricating oil to pass by a lubricated means arranged to be in association with said compressing-operation-drive means, said lubricating oil passageway means having one end brought into communication with said operating chamber means in synchronism with opening of said suction valve means and the other end formed to be in constant communication with a predetermined region in said compressor in which a pressure higher than a pressure in said operating chamber means during said volume expanding phase prevails.

2. A refrigerant compressor according to claim 1, wherein said suction valve means comprises a reed type valve.

3. A refrigerant compressor according to claim 2, wherein said compressor comprises a swash plate type compressor including:

a cylinder block assembly having a pair of front and rear cylinder blocks defining therein a central bore axially extending therethrough, a plurality of axial cylinder bores arranged around said central bore, and a swash plate chamber arranged at a connecting portion of said front and rear cylinder blocks;

a plurality of double-headed pistons slidably received in and cooperating with said plurality of cylinder bores to define said operating chamber means;

a drive shaft rotatably received in said central bore of said cylinder block assembly; and a swash plate arranged in said swash plate chamber and mounted on said drive shaft to rotate with said drive shaft, said drive shaft and said swash plate being operatively engaged with said plurality of double-headed pistons to define said compressing-operation-drive means.

4. A refrigerant compressor according to claim 3, wherein at least one of said cylinder bores of said cylinder block assembly of said swash plate type compressor is arranged to be contiguous with said one end of said lubricating oil passageway means.

5. A refrigerant compressor according to claim 4, wherein said cylinder block assembly is provided with more than four cylinder bores, and wherein said one end of said lubricating oil passageway means is contiguous with at least two of said more than four cylinder bores, said at least two cylinder bores being to permit a different one of said more than four cylinder bores to be located therebetween.

6. A refrigerant compressor according to claim 3, wherein said lubricating oil passageway means includes a part thereof formed by said central bore of said cylinder block assembly, and wherein said other end of said lubricating oil passageway means is fluidly communicated with said swash plate chamber.

7. A refrigerant compressor according to claim 3, wherein said reed valve of said suction valve means is interposed between each axial end of said cylinder block assembly and a valve plate, and wherein a part of said lubricating oil passageway means is provided so as to extend between each axial end of said cylinder block assembly and said reed valve.

8. A swash plate type refrigerant compressor which comprises:

a pair of axially combined front and rear cylinder blocks defining therein a central through-bore extending axially, a plurality of axial cylinder bores arranged around said central through-bore, and a swash plate chamber formed in a connecting portion of said front a rear cylinder blocks, said swash plate chamber being capable of receiving refrigerant gas before compression when said refrigerant gas enters therein from the exterior of said compressor;

a drive shaft arranged in said central through-bore and rotatably supported by radial bearings, said drive shaft having a mounting portion thereof extending through said swash plate chamber;

a swash plate mounted on said mounting portion of said drive shaft to be rotated together in said swash plate chamber, and to be axially held by said front and rear cylinder blocks via a pair of axially spaced sliding type thrust bearings;

a plurality of pistons slidably arranged in said axial cylinder bores and operatively engaged with said swash plate via shoes;

front and rear valve plates, each having suction ports and discharge ports formed therein so as to be in registration with said respective axial cylinder bores;

front and rear housings arranged so as to close axial ends of said combined front and rear cylinder blocks via front and rear valve plates, said front and rear housings being fixedly connected to said front and rear cylinder blocks by a plurality of axial screw bolts, and each of said front and rear housings having therein a radially inner discharge chamber for compressed refrigerant gas and a radially outer suction chamber for the refrigerant gas before compression;

suction valves held on each of said front and rear valve plates so as to open and close said suction ports in relation to sliding of said plurality of pistons in said axial cylinder bores;

discharge valves held on each of said front and rear valve plates so as to open and close said discharge ports in relation to sliding of said plurality of pistons in said axial cylinder bores;

suction passageway means arranged to extend between said swash plate chamber and said suction chambers of said front and rear housings through spaces extending around first predetermined axial screw bolts selected from said plurality of axial screw bolts; and fluid communicating passageway means for providing fluid communication between said suction passageway means and said central through-bore of said front and rear cylinder blocks thereby permitting a part of the refrigerant gas before compression to flow from said suction passageway means to said central through-bore of said front and rear cylinder blocks.

9. A swash plate type refrigerant compressor according to claim 8, wherein said radial bearings rotatably supporting said drive shaft comprise a pair of front and rear sliding type radial bearings.

10. A swash plate type refrigerant compressor according to claim 8, wherein each of said front and rear valve plates is provided with at least one fluid passageway extending between one of said plurality of axial cylinder bores and said central through-bore of said combined front and rear cylinder blocks whereby a fluid communication is provided between one of said plurality of axial cylinder bores and said central through-bore when one of the suction valves associated with said one of said plurality of axial cylinder bores opens the associated suction port.

11. A swash plate type refrigerant compressor according to claim 8, wherein each of said sliding type thrust bearings comprises:

a stationary annular ring and a movable annular ring, said stationary and movable annular rings having coaxial central bores formed therein so as to permit said drive shaft to extend therethrough;

said stationary annular ring having a first sliding face, and a second supporting face opposite to said first sliding face and being in contact with said front or rear cylinder block, and said movable annular ring having a first sliding face being in slide contact with said first sliding face of said stationary annular ring, and a second supporting face opposite to said first sliding face and being in contact with said swash plate.

12. A swash plate type refrigerant compressor according to claim 11, wherein said first sliding face of said stationary annular ring is provided with curved grooves formed therein so as to radially extend from said central bore to a circumference of said stationary annular ring, and being in communication with axial recesses formed in a wall of said central bore.

13. A swash plate type refrigerant compressor according to claim 12, wherein at least one of said first sliding faces of said stationary and movable annular rings of said sliding type thrust bearing is coated with synthetic resin film having a low friction property.

14. A swash plate type refrigerant compressor according to claim 13, wherein at least one of said first sliding faces of said stationary and movable annular rings of said sliding type thrust bearing is coated with a film of fluorocarbon polymers.

15. A swash plate type refrigerant compressor suitable for being incorporated in a climate control system, which comprises:

a pair of axially combined front and rear cylinder blocks defining therein a central through-bore extending axially, a plurality of axial cylinder bores arranged around said central through-bore, and a swash plate chamber formed in a connecting portion of said front and rear cylinder blocks, said swash plate chamber being capable of receiving refrigerant gas before compression when said refrigerant gas enters therein upon returning from the climate control system;

a drive shaft arranged in said central through-bore and rotatably supported by radial bearings, said drive shaft having a mounting portion thereof extending through said swash plate chamber;

a swash plate mounted on said mounting portion of said drive shaft to be rotated together with said drive shaft in said swash plate chamber and to be axially held by said front and rear cylinder blocks via a pair of axially spaced thrust bearings;

a plurality of pistons slidably arranged in said axial cylinder bores and operatively engaged with said swash plate via shoes;

front and rear valve plates, each having suction ports and discharge ports formed therein so as to be in registration with said respective axial cylinder bores;

front and rear housings arranged so as to close axial ends of said combined front and rear cylinder blocks via front and rear valve plates, said front and rear housings being fixedly connected to said front and rear cylinder blocks by means of a plurality of axial screw bolts, and each of said front and rear housings having therein a radially inner discharge chamber for compressed refrigerant gas and a radially outer suction chamber for said refrigerant gas before compression;

suction valves held on each of said front and rear valve plates so as to open and close said suction ports in relation to sliding of said plurality of pistons in said axial cylinder bores;

discharge valves held on each of said front and rear valve plates so as to open and close said discharge ports in relation to sliding of said plurality of pistons in said axial cylinder bores;

suction passageway means arranged so as to extend between said swash plate chamber and said suction chambers of said front and rear housings through spaces extending around said respective axial screw bolts; and fluid passageway means arranged in each of said front and rear valve plates so as to extend between at least a predetermined one of said cylinder bores and said central through-bore to thereby provide a fluid communication therebetween in synchronism with opening of said suction valve associated with said predetermined cylinder bore.

16. A swash plate type refrigerant compressor according to claim 15, wherein said fluid passageway means includes a plurality of fluid passageways arranged between two or more predetermined cylinder bores of said plurality of cylinder bores and said central through-bore of said front and rear cylinder blocks for proving fluid communication between said two or more predetermined cylinder bores and said central through-bore in synchronism with opening of said suction valves associated with said two or more predetermined cylinder bores.

17. A swash plate type refrigerant compressor according to claim 16, wherein said two or more predetermined cylinder bores of said plurality of cylinder bores are non-neighbor cylinder bores.

18. A swash plate type refrigerant compressor according to claim 15, wherein said swash plate type refrigerant compressor is further provided with a discharge pulsation damping chamber means formed at a predetermined upper portion of said axially combined front and rear cylinder blocks so as to be constantly fluidly communicated with said discharge chambers of said front and rear housings and to be capable of being communicated with said climate control system, said discharge pulsation damping chamber means having an oil separating means incorporated therein for separating lubricating oil from the compressed refrigerant gas, and a portion thereof being in constant communication with said swash plate chamber via oil return passageways containing therein flow restricting passageways formed in said axial ends of said axially combined front and rear cylinder blocks.

19. A swash plate type refrigerant compressor according to claim 18, wherein said discharge pulsation damping chamber means is provided to have an axially elongated cavity extending through a plane in which combining of said front and rear cylinder blocks is carried out with an intervention of a sealing gasket, and fluidly communicated with said discharge chambers of said front and rear housings via individual discharge gas passageways having end apertures opening toward said elongated cavity.

20. A swash plate type refrigerant compressor according to claim 19, wherein said sealing gasket arranged in said combining plane of said front and rear cylinder blocks is provided with a sheet of an oil separating screen element extending in said axially elongated cavity so as to form said oil separating means.

21. A swash plate type refrigerant compressor according to claim 20, wherein said oil separating screen element is arranged to face each of said end apertures of said discharge gas passageways to thereby permit the lubricating oil contained in the compressed refrigerant gas to be separated when the flow of the compressed refrigerant gas discharging from said discharge gas passageways impinges upon said oil separating screen element.

22. A swash plate type refrigerant compressor according to claim 21, wherein said sheet of oil separating screen element of said sealing gasket is provided with a plurality of through-holes permitting the compress refrigerant gas to pass therethrough.

23. A swash plate type refrigerant compressor according to claim 18, wherein said oil return passageways include oil passageway portions extending around second predetermined axial screw bolts selected from said plurality of axial screw bolts, said oil passageway portions of said oil return passageway functioning as an oil reservoir having a substantial volume.

24. A swash plate type refrigerant compressor according to claim 15, wherein said swash plate type refrigerant compressor is provided with a discharge pulsation damping chamber means formed at an upper portion of said axially combined front and rear cylinder blocks so as to be constantly fluidly communicated with said discharge chambers of said front and rear housings via individual discharge gas passageways and to be capable of being communicated with said climate control system, and an oil reservoir chamber means formed at a predetermined lower portion of said axially combined front and rear cylinder blocks so as to be fluidly communicated with said swash plate chamber via an oil flow restriction passageway and with said discharge pulsation damping chamber unit via an oil return groove extending through a combined portion of said front and rear cylinder blocks.

* * * * *